US006669016B1

(12) United States Patent
Carson

(10) Patent No.: US 6,669,016 B1
(45) Date of Patent: Dec. 30, 2003

(54) SHOE CARRIER AND STORAGE DEVICE

(76) Inventor: Edna Carson, 1981 Elwood St., Muskegon, MI (US) 49442

( * ) Notice: Subject to any disclaimer, the term of this patent is extended or adjusted under 35 U.S.C. 154(b) by 0 days.

(21) Appl. No.: 09/971,859

(22) Filed: Oct. 5, 2001

(51) Int. Cl.[7] ..... B65D 85/18
(52) U.S. Cl. ..... 206/278; 190/111; 383/38
(58) Field of Search ..... 383/38, 39, 40; 206/463, 278, 466, 470; 190/16, 111, 107, 278; D6/315

(56) References Cited

U.S. PATENT DOCUMENTS 1,094,009 A * 4/1914 Parkhurst ..... 383/38
1,261,733 A * 4/1918 Gerlach ..... 383/39 X
1,975,294 A * 10/1934 Sand et al. ..... 206/289
D140,519 S * 3/1945 Pascal ..... 383/39 X
2,832,389 A * 4/1958 Smith ..... 383/38
4,804,084 A * 2/1989 Markovich ..... 206/283
4,859,084 A * 8/1989 Kaumeyer ..... 383/39
4,949,843 A 8/1990 Stokes
5,002,401 A 3/1991 Blackman
5,120,108 A 6/1992 Watson et al.
5,360,215 A 11/1994 Ruben
5,538,137 A * 7/1996 Deioma et al. ..... 190/109 X
D407,559 S 4/1999 Roegner
5,984,092 A 11/1999 Heard-Willmon

* cited by examiner

*Primary Examiner*—Tri M. Mai

(57) ABSTRACT

A shoe carrier and storage device for holding a plurality of shoes for travel and storage purposes. The shoe carrier and storage device includes an elongated panel having a first end, a second end, a first side edge and a second side edge. The elongated panel is flexible. Each of a plurality of pockets has an opening extending therein for accessing an interior of the pockets. Each of the pockets is attached to the elongated panel. The pockets comprise a flexible fabric. Each of a plurality of shoes may be positioned in one of the pockets.

1 Claim, 2 Drawing Sheets

SHOE CARRIER AND STORAGE DEVICE

BACKGROUND OF THE INVENTION

1. Field of the Invention

The present invention relates to travel storage for shoes and more particularly pertains to a new shoe carrier and storage device for holding a plurality of shoes for travel and storage purposes.

2. Description of the Prior Art

The use of travel storage for shoes is known in the prior art. More specifically, travel storage for shoes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,699,267; U.S. Pat. No. 2.634,835; U.S. Pat. No. 4,753,342; U.S. Des. Pat. No. 257,411; U.S. Pat. No. 2,718,911; and U.S. Des. Pat. No. 152,653.

While these devices fulfill their respective, particular objectives and requirements, the aforementioned patents do not disclose a new shoe carrier and storage device. The inventive device includes an elongated panel having a first end, a second end, a first side edge and a second side edge. The elongated panel is flexible. Each of a plurality of pockets has an opening extending therein for accessing an interior of the pockets. Each of the pockets is attached to the elongated panel. The pockets comprise a flexible fabric. Each of a plurality of shoes may be positioned in one of the pockets.

In these respects, the shoe carrier and storage device according to the present invention substantially departs from the conventional concepts and designs of the prior art, and in so doing provides an apparatus primarily developed for the purpose of holding a plurality of shoes for travel and storage purposes.

SUMMARY OF THE INVENTION

In view of the foregoing disadvantages inherent in the known types of travel storage for shoes now present in the prior art, the present invention provides a new shoe carrier and storage device construction wherein the same can be utilized for holding a plurality of shoes for travel and storage purposes.

The general purpose of the present invention, which will be described subsequently in greater detail, is to provide a new shoe carrier and storage device apparatus and method which has many of the advantages of the travel storage for shoes mentioned heretofore and many novel features that result in a new shoe carrier and storage device which is not anticipated, rendered obvious, suggested, or even implied by any of the prior art travel storage for shoes, either alone or in any combination thereof.

To attain this, the present invention generally comprises an elongated panel having a first end, a second end, a first side edge and a second side edge. The elongated panel is flexible. Each of a plurality of pockets has an opening extending therein for accessing an interior of the pockets. Each of the pockets is attached to the elongated panel. The pockets -comprise a flexible fabric. Each of a plurality of shoes may be positioned in one of the pockets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe carrier and storage device apparatus and method which has many of the advantages of the travel storage for shoes mentioned heretofore and many novel features that result in a new shoe carrier and storage device which is not anticipated, rendered obvious, suggested, or even implied by any of the prior art travel storage for shoes, either alone or in any combination thereof.

It is another object of the present invention to provide a new shoe carrier and storage device which may be easily and efficiently manufactured and marketed.

It is a further object of the present invention to provide a new shoe carrier and storage device which is of a durable and reliable construction.

An even further object of the present invention is to provide a new shoe carrier and storage device which is susceptible of a low cost of manufacture with regard to both materials and labor, and which accordingly is then susceptible of low prices of sale to the consuming public, thereby making such shoe carrier and storage device economically available to the buying public.

Still yet another object of the present invention is to provide a new shoe carrier and storage device which provides in the apparatuses and methods of the prior art some of the advantages thereof, while simultaneously overcoming some of the disadvantages normally associated therewith.

Still another object of the present invention is to provide a new shoe carrier and storage device for holding a plurality of shoes for travel and storage purposes.

Yet another object of the present invention is to provide a new shoe carrier and storage device which includes an elongated panel having a first end, a second end, a first side edge and a second side edge. The elongated panel is flexible. Each of a plurality of pockets has an opening extending therein for accessing an interior of the pockets. Each of the pockets is attached to the elongated panel. The pockets comprise a flexible fabric. Each of a plurality of shoes may be positioned in one of the pockets.

Still yet another object of the present invention is to provide a new shoe carrier and storage device that holds multiple pairs of shoes in a convenient manner while traveling so that a user of the device has. multiple choices of foot attire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
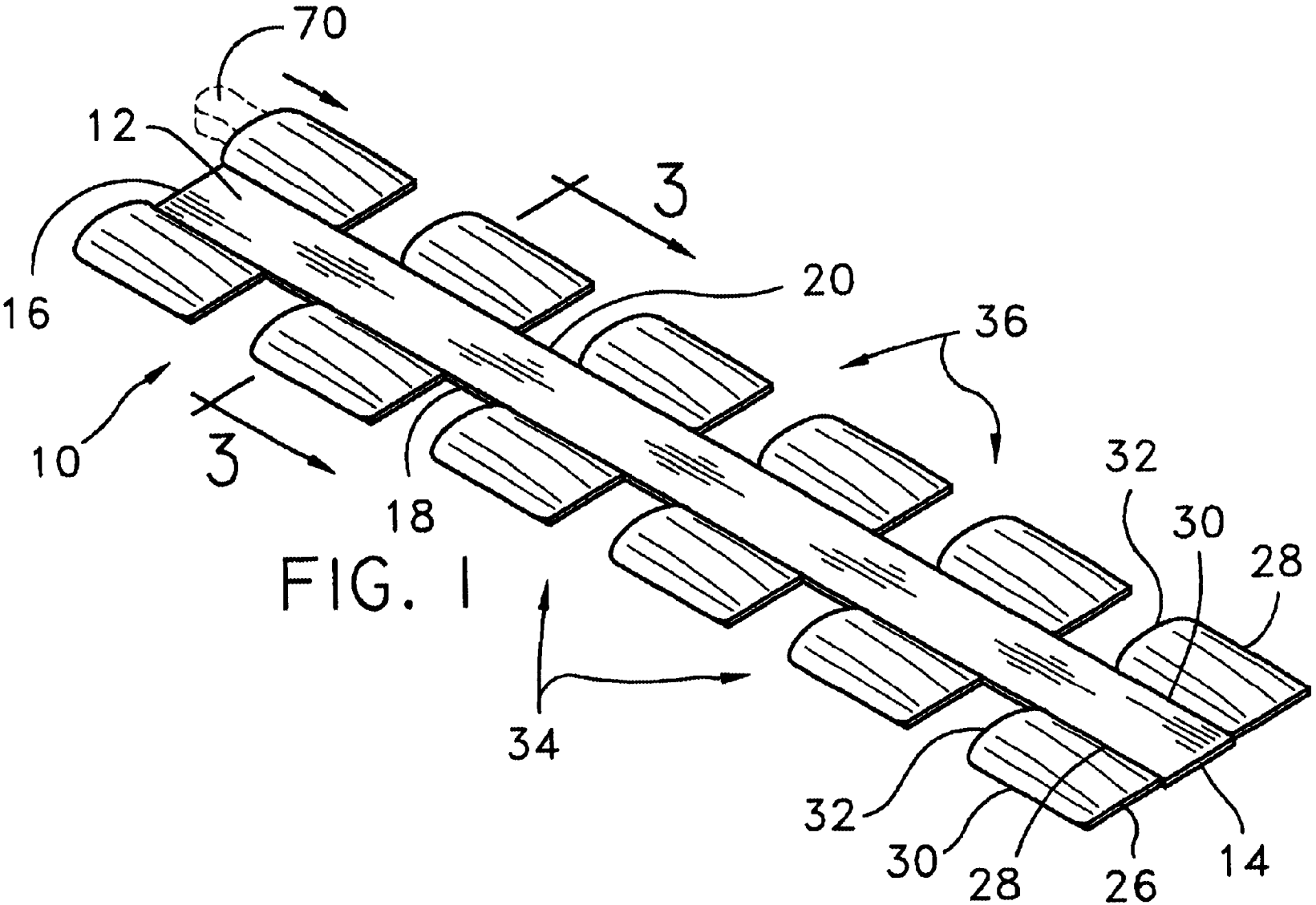
FIG. 1 is a schematic perspective view of a new shoe carrier and storage device according to the present invention.
Figure 2:
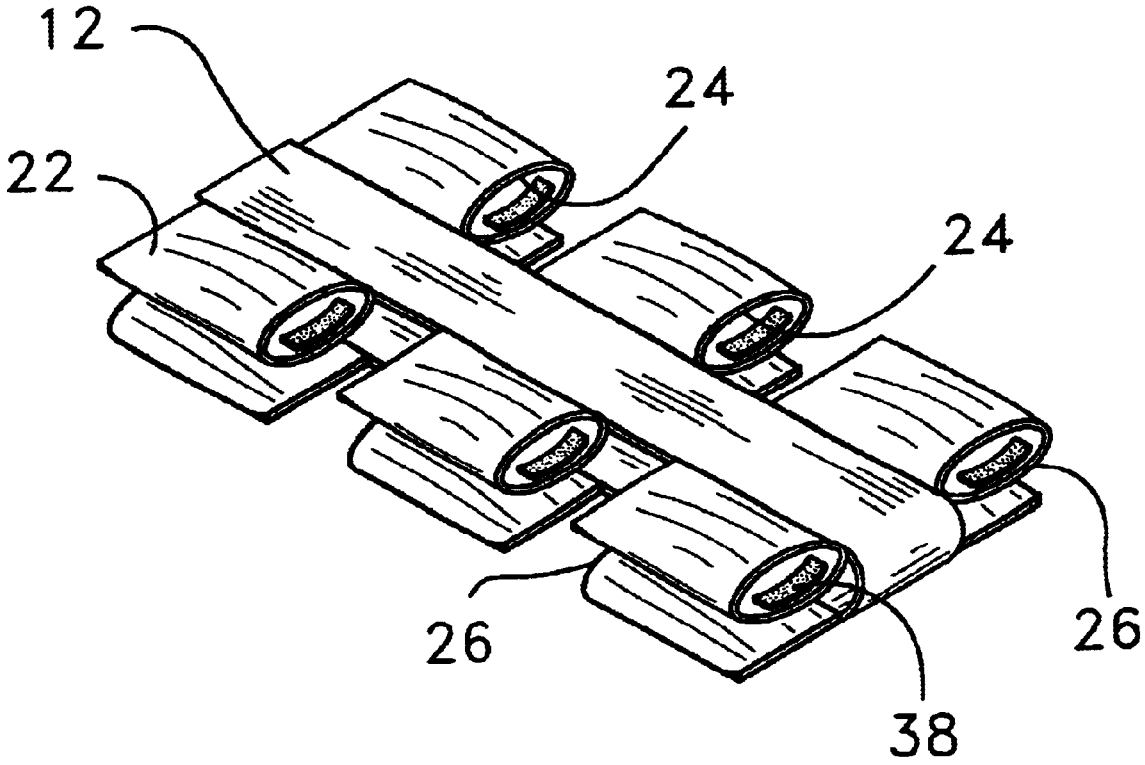
FIG. 2 is a schematic perspective view of the present invention.
Figure 3:
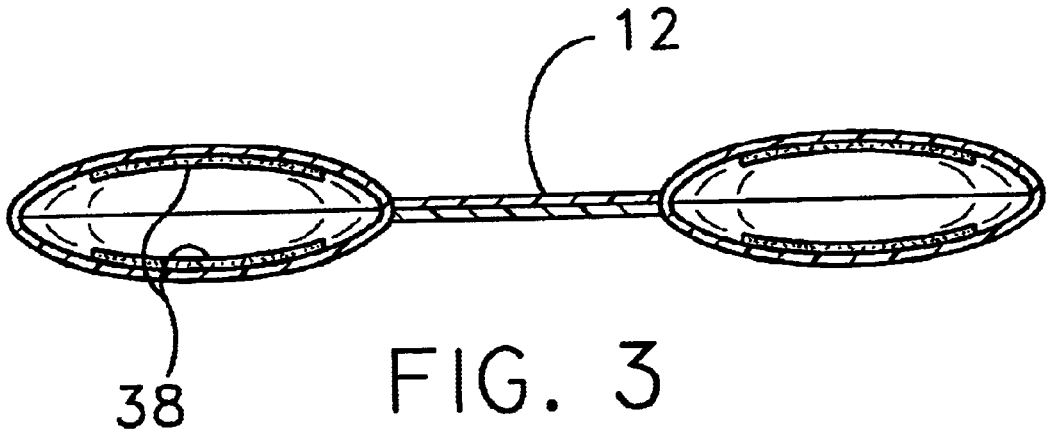
FIG. 3 is a schematic cross-sectional view taken along line 3—3 of FIG. 1 of the present invention.

With reference now to the drawings, and in particular to FIGS. 1 through 3 thereof, a new shoe carrier and storage device embodying the principles and concepts of the present invention and generally designated by the reference numeral 10 will be described.

As best illustrated in FIGS. 1 through 3, the shoe carrier and storage device 10 generally includes an elongated panel 12 having a first end 16, a second end 14, a first side edge 18 and a second side edge 20. The elongated panel 12 is flexible.

Each of a plurality of pockets 22 has an opening 24 extending therein for accessing an interior of the pockets 22. Each of the pockets 22 is attached to the elongated panel 12. The pockets 22 have a first edge 32, a second edge 28, a third edge 30 and a fourth edge 26. The first edge 32 forms the opening 24. The second edges 28 of a first set 34 of the pockets 22 are attached to the first side edge 18 such that the openings 24 in the first set 34 are facing the first end 16 of the panel. The third edges 30 of a second set 36 of the pockets 22 are attached to the second side edge 20 such that the openings 22 in the second set 36 are facing the first end 16 of the panel 12. Each of the first edges 32 preferably extends outward in an arcuate shape. The pockets 22 are spaced from each other. Each of the pockets 22 comprises a flexible fabric such as leather, cotton or vinyl. Each of a plurality of shoes 70 may be positioned in one of the pockets 22. Preferably, each the first 34 and second 36 sets includes 6 pockets.

A plurality of closing members 38 selectively closes the pockets 22. Each of the closing members 38 is positioned in one of the pockets 22 and located adjacent to the opening 24. Each of the closing members 38 ideally comprises a hook and loop securing means.

In use, the pockets 22 are adapted for each holding a show. This allows the device 10 to hold six pairs of shoes 70 to protect the shoes 70 and to protect other items which are packed for traveling. The panel 12 is flexible so that it can be folded as in FIG. 2 for easy packing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe storage and transporting device for holding a plurality of shoes, said device comprising:

an elongated panel having a first end, a second end, a first side edge and a second side-edge, said elongated panel being flexible;

a plurality of pockets generally disposed outside a perimeter of said elongated panel, each of said pockets having an opening extending therein for accessing an interior of said pockets, each of said pockets being attached to said elongated panel, said plurality of pockets having a first set of pockets and a second set of pockets, each one of said first set of pockets being disposed in a linear array along said first side edge of said elongated panel, each one of said second set of pockets being disposed in a linear array along said second side edge of said elongated panel; each of said pockets having a first edge, a second edge, a third edge and a fourth edge, said first edge forming said opening, said second edges of a first set of said pockets being attached to said first side edge such that said openings in said first set are facing said first end of said panel, said third edges of a second set of said pockets being attached to said second side edge such that said openings in said second set are facing said first end of said panel, each of said first and second sets including six of said pockets, each of said first edges extending outward in an arcuate shape, said pockets being spaced from each other, each of said pockets comprising a flexible fabric, wherein each of a plurality of shoes may be positioned in one of said pockets; and a plurality of closing members for selectively closing said pockets, each of said closing members being positioned in one of said pockets and located adjacent to said opening, each of said closing members comprising a hook and loop securing means.

* * * * *